United States Patent [19]

Hilfiker

[11] Patent Number: 4,618,283

[45] Date of Patent: Oct. 21, 1986

[54] ARCHWAY CONSTRUCTION UTILIZING ALTERNATING REINFORCING MATS AND FILL LAYERS

[75] Inventor: William K. Hilfiker, Eureka, Calif.

[73] Assignee: Hilfiker Pipe Co., Eureka, Calif.

[21] Appl. No.: 647,841

[22] Filed: Sep. 6, 1984

[51] Int. Cl.[4] ..... E21D 9/00

[52] U.S. Cl. ..... 405/124; 405/150; 405/126; 405/149

[58] Field of Search ..... 405/150, 151, 152, 153, 405/124, 125, 126, 127, 272, 258, 262, 149

[56] References Cited

U.S. PATENT DOCUMENTS

| | | | |
|---|---|---|---|
| 587,392 | 8/1897 | Gray | 405/126 |
| 678,605 | 7/1901 | Wolcott et al. | 405/124 |
| 701,034 | 5/1902 | Gray | 405/124 |
| 4,329,089 | 5/1982 | Hilfiker et al. | 405/262 |
| 4,413,928 | 11/1983 | Tucker | 405/258 X |
| 4,505,621 | 3/1985 | Hilfiker et al. | 405/258 X |
| 4,519,730 | 5/1985 | Horimatsu | 405/258 |

FOREIGN PATENT DOCUMENTS

| | | | |
|---|---|---|---|
| 437789 | 11/1935 | United Kingdom | 405/16 |

*Primary Examiner*—Dennis L. Taylor

*Attorney, Agent, or Firm*—Limbach, Limbach & Sutton

[57] ABSTRACT

An archway construction positioned over a pathway for supporting a crossroad or the like. The archway has three primary sections including an upper ceiling section which spans the pathway and which is supported on two vertical support sections positioned on opposite sides of the pathway. The three primary sections are each comprised of alternating layers of compacted soil fill and steel reinforcing mats, with the mats serving to stabilize the fill. The ceiling section preferably includes at least three reinforcing mats including a lower flat mat and a pair of curved upper mats, with the three mats being separated by layers of fill except in a central region midway between the vertical support sections where the three mats are connected together. The two upper curved mats of the ceiling section provide vertical support for the center of the lower flat mat.

35 Claims, 18 Drawing Figures

ARCHWAY CONSTRUCTION UTILIZING ALTERNATING REINFORCING MATS AND FILL LAYERS

Description

1. Technical Field

The present invention relates generally to archway constructions and more particularly to an archway of fill reinforced by metal mats.

2. Background Art

Earth retaining walls are sometimes constructed utilizing stacked, generally rectangular mats in the form of steel wire fabric sheets having one end bent up to serve as a portion of the wall face. As described in U.S. Pat. No. 4,117,686 entitled "Fabric Structure for Earth Retaining Walls", the contents of which are fully incorporated herein, a retaining wall may be constructed by positioning a first course of steel wire mats with the upwardly-extending face section being positioned along the wall line. Relatively large rocks or filtering mats are positioned toward the front of the mat adjacent the face section, with the remainder of the mat being topped with a layer of finer fill. The finer fill is compacted and a second course of mats is positioned over the bottom course. The face sections of the mats are fastened together. The second course is filled in the same manner as the first course until the desired wall height is achieved.

Patent application Ser. No. 497,867 entitled "Wire Retaining Wall Apparatus And Method For Earth Formations" filed on May 25, 1983 and French Pat. No. 75 07114 published Oct. 1, 1976 disclose further variations of wire reinforced earth retaining walls.

Although the above-noted earth retaining walls are relatively low in cost and are quite stable, they are not suitable in some applications. For example, if a roadway is to be constructed at the base of a steep hill, it is frequently not practical to stabilize the entire hill. Typically, a tunnel or archway is the only feasible alternative. However, conventional archways are frequently expensive and difficult to construct.

The present invention relates to an improved archway which incorporates many of the advantages of wire reinforced earthen retaining walls and avoids the disadvantages of conventional archway construction techniques. The disclosed archway may be constructed at low cost and is very stable and capable of bearing large surface loads, including roadways. These and other advantages of the present invention will become apparent to those having average skill in the art upon a reading of the following Best Mode For Carrying Out The Invention together with the drawings.

DISCLOSURE OF THE INVENTION

An archway construction positioned over a pathway is disclosed. The construction includes a pair of vertical support sections disposed on opposite sides of the pathway. A ceiling section, spanning the pathway, is supported by the two vertical support sections.

The vertical support sections and the ceiling section each include a plurality of reinforcing mats separated by one or more layers of unbound fill, such as soil. In a preferred embodiment, the vertical support sections each include a lower vertical portion and an upper cantilevered portion, with the cantilevered portion extending partway over the pathway.

The reinforcing mats are preferably fabricated from steel wire strands, including longitudinal strands and cross strands transverse to the longitudinal strands to form an orthogonal grid. The longitudinal and cross strands are connected together at their intersections by welding or the like.

BEST MODE FOR CARRYING OUT THE INVENTION

Figure 1:
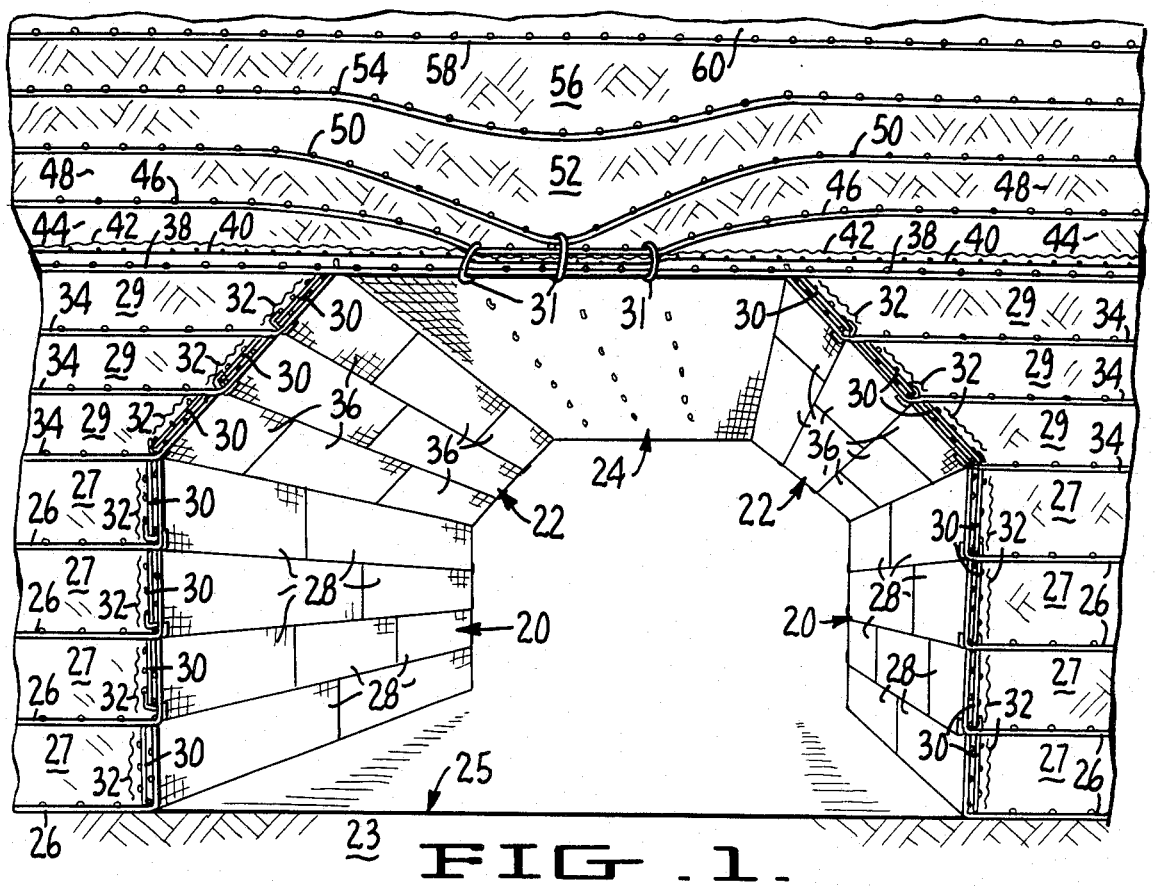
FIG. 1 is a cross-sectional perspective view of a preferred embodiment archway in accordance with the subject invention.

Referring now to the drawings, FIGS. 3 through 10 depict a sequence of construction steps for fabricating a preferred embodiment archway as shown in FIG. 1. The archway extends over a pathway, generally designated by the numeral 25. A road, aqueduct or the like may be constructed along pathway 25.

The preferred embodiment archway is constructed by first excavating a channel where the pathway is desired, with the channel being typically four to six times as wide as the pathway. As will become apparent, the width of the channel may be varied depending upon various factors including the height of the archway, the amount of loading on the archway and the like. A road, aqueduct or the like is then constructed along the center bottom of the channel along the pathway using conventional construction methods. The parallel strips on opposite sides of the pathway 25 serve as the foundation of the subject archway. Unless the side strips are rock, it will be necessary to compact the strips to ensure adequate support for the archway. The surface of the strips generally coincides with the surface of the pathway.

As can best be seen in FIG. 1, the preferred embodiment archway includes a pair of vertical support sections and a ceiling section which is supported by the support sections. The support sections each include a vertical portion, generally designated by the numeral 20, and a cantilevered portion, generally designated by the numeral 22. Cantilevered portions 22 extend over part of pathway 25. Horizontal ceiling section, generally designated by the numeral 24, is disposed over the two cantilevered portions spanning the pathway.

The vertical support sections and the ceiling section are each comprised of alternating wire reinforcing mats and layers of fill. The mats are fabricated from steel wire strands which are welded together to form an orthogonal grid. The wires are typically five, seven or nine gauge wires and include a series of longitudinal wires spaced apart typically two inches and a series of cross wires, welded to the longitudinal wires, which are typically six inches apart. The mats are disposed within the vertical support and ceiling sections with the longitudinal wires being generally transverse to the pathway. As will be subsequently described, some of the mats are formed to various shapes by bending and the like. After the mats are formed, the mats are coated with zinc dip, epoxy, galvanizing material or the like to prevent corrosion.

The wire mats used in vertical portions 20 of the support sections are substantially as disclosed in previously-noted U.S. Pat. No. 4,117,686 and application Ser. No. 497,867. As can best be seen in FIG. 1, the vertical portion of the support sections includes a plurality of wire mats each of which includes a horizontal mat base 26 and a vertical mat face 28. A cross wire is positioned at the juncture of the mat base and face.

Figure 3:
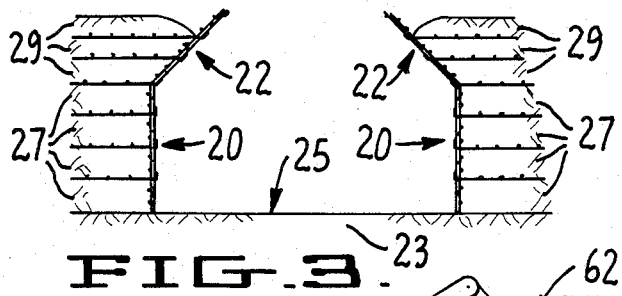
FIGS. 3–10 illustrate the method of constructing the preferred embodiment archway in accordance with the subject invention.

As can be seen in FIG. 3, the vertical portion 20 of the support sections 20 is installed first. An initial course of wire mats is positioned along both sides of the pathway 25 adjacent to one another on the prepared surface 23 along the entire length of the portion of the pathway to be covered by the archway. The mat faces 28 extend upwards and generally coincide with the periphery of the pathway.

Once the bottom courses of wire reinforcing mats have been positioned, unbound fill is laid over the rear portion of mat bases 26 and compacted. The fill depth generally corresponds to the top cross wire of the mat faces 28. Unbound fill, as the term is used herein, includes granular material such as various types of soil comprising, for example, clay, sand, gravel, broken rock and the like. Unbound fill, even when compacted, remains in unbound granular form and has a relatively low resistance to shear faces. Unbound fill typically has a shearing strength on the order of 500 p.s.i. or less. The term unbound fill is not intended to encompass, for example, a solid mass of concrete or other materials which are capable of resisting relatively high shear forces and which typically have a shearing strength (across grain) on the order of 1,000 p.s.i. or more.

A void in the fill is left adjacent the mat faces 28 so that a series of backing mats 30 (FIG. 1) may be positioned behind the mat faces. Backing mats 30 are also fabricated from welded steel wire to form a grid pattern which is somewhat finer than the reinforcing wire mats. The length and width of the backing mats are slightly less than that of the mat faces 28. Preferably, backing mats 30 are staggered with respect to the reinforcing mats such that the center of the backing mats falls at the juncture of adjacent mat faces. Half lengths of the backing mats are used at the ends of each mat course.

When the backing mats 30 are in position, fine wire mesh 32 is disposed along the full length of the mat courses, immediately behind the backing mats. Wire mesh 32 typically has longitudinal and cross wires which are spaced one-quarter inch apart and a width which is approximately the same as the height of the mat faces 28. The mat face 28, backing mat 30 and wire mesh 32 are secured together using hog rings (not shown) or other similar connecting means. As will be subsequently described in greater detail in connection with the FIG. 13 embodiment of the subject invention, the reinforcing mats include connecting prongs which extend upwards from the top of the mat faces.

Once the bottom or first courses of mats have been laid, second courses of wire reinforcing mats are positioned over the bottom courses. The cross wire located at the juncture of the second course mat base and face rests on the top cross wire of the lower mat, with the mat faces being generally coplanar. Preferably, the second course mats are staggered with respect to the first course mats, as can best be seen in FIG. 1. The prongs of the bottom course mats extend upwards past the mat base and behind the mat face of the second course of reinforcing mats.

When the second course mats are in position, back fill 27 is added, in a manner similar to that of the first course, thereby securing the mats in position. Again, a void is left in the region adjacent mat faces 28. Backing mats 30 are then installed immediately behind the second course mat faces, between the mat faces and the upward-extending prongs of the first course mats. The wire mesh 32 is then installed in the same manner as the first course. Gravel is then poured through the front portion of the second course mat base 26 so as to fill the void between the first course back fill and the first course mat face. The gravel is then compacted by rodding or the like, with the top of the gravel coinciding with the mat base 26 of the second course. Backing mats 30, together with wire mesh 32, prevent the gravel from escaping through the mat faces 28, while permitting the passage of water.

The third and fourth courses of reinforcing mats of the vertical portion 20 of support section are assembled in a similar manner. The number of vertical portion courses can be increased or decreased, depending upon various factors, including the desired height of the archway.

The three courses which form the cantilevered portions 22 of the vertical support section, also include reinforcing wire mats comprising a horizontal mat base 34 and a mat face 36. The wire mats of the cantilevered wall portions are similar in construction to the mats of the vertical wall portion except that the base and face sections are at an approximate 135 degree angle rather than 90 degrees.

The first or bottom course wire mats of cantilevered portions 22 are positioned over the top course of the vertical wall portion 20 in a staggered arrangement. The cross wire at the bend in the first course cantilevered section mat is positioned adjacent the top cross wire of the mat immediately below and the mats are pinned together using hog rings or the like. Backfill 29 is then added which secures the mats in place. A void is left in the fill in the region surrounding the mat faces 36. Backing mats 30 are then positioned adjacent and behind the mat faces 36 followed by the wire mesh 32. Hog rings are then used to pin the assembly together. Gravel is poured through the foward portion of the mat base 34 to fill the void adjacent mat faces 28 of the top course of the vertical portion 20 mats. The gravel is then compacted by rodding.

The second and third courses of the cantilevered wall portion 22 are then assembled in a similar manner. As can best be seen in FIG. 3, the region adjacent the mat faces of the top course of cantilevered portion 22 section is left unfilled.

Figure 4:
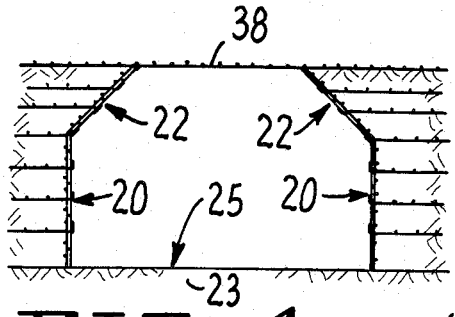

As shown in FIG. 4, a series of flat reinforcing mats 38 are then positioned on top of the vertical support section, over pathway 25, as the first step in assembling the horizontal ceiling section 24 of the archway. Flat mats 38 are similar in construction to the reinforcement mats associated with the vertical and cantilevered portions of the vertical support sections, except that the mat faces are excluded. It is preferable that the distal ends of the flat reinforcing mats 38 extend away from the pathway at least approximately the same distances as the vertical support section reinforcing mats.

Backfill in the form of unbound fill is then laid over the extreme distal ends of flat mats 38 to secure the mats in position. The uppermost cross wires of the top mat faces 36 of the vertical support section are then secured to the adjacent cross wires of the flat mats 38 using hog rings or the like, thereby providing upper support for the mat faces. Gravel is then poured through the flat mats 38 to fill the void adjacent the top mat faces 36. The gravel is then compacted by rodding.

Flat backing mats 40, similar to backing mats 32, are then laid over reinforcing mats 38. Since the distal ends of flat mats 38 are covered with back fill at this time, only the central portions of the flat mats are covered with the backing mats. The backing mats preferably extend at least along the width of pathway 25. Next, wire mesh 42, similar to wire mesh 32, is disposed over backing mats 40.

Figure 5:
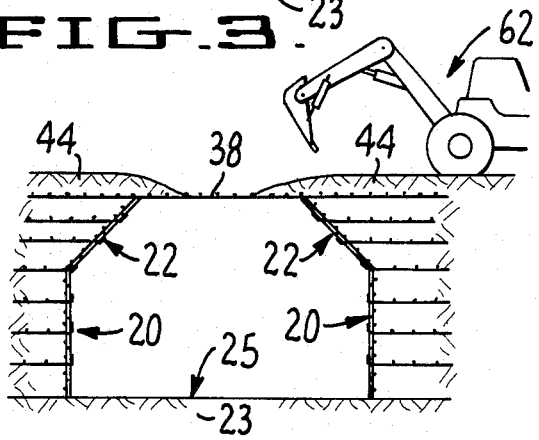

Once the backing mats 40 and wire mesh 42 are in position, fill 44 is laid over flat mat 38 with the exception of a longitudinal region which extends down the center of the flat mat. It is preferable that the bottom layer of fill 44 be comrised of gravel, which is then covered by compacted soil. A backhoe 62, which is positioned a sufficient distance away from the center of the flat mats 38 so as not to collapse the uncompleted structure, is used to lay back fill 44. Preferably, a gradual slope is provided at the periphery of back fill 44 adjacent the exposed central region of flat mats 38 as shown in FIG. 5.

Figure 6:
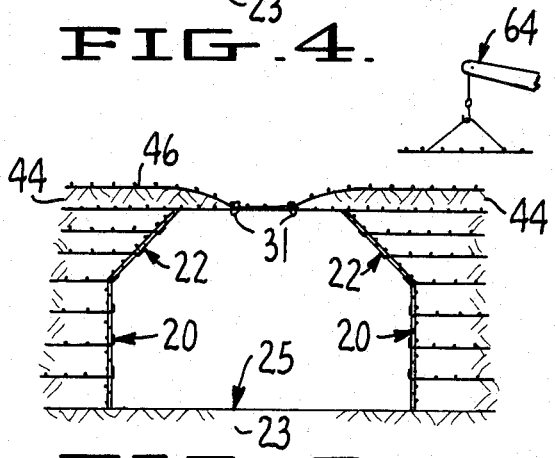

Once fill 44 has been compacted, a second layer of wire mats 46 is positioned over flat mats 38. Mats 46 have been preformed, as shown in FIG. 6, to conform to the contours of fill 44 and includes a depressed central section which extends into the recess formed between the edges of fill 44 and contacts mats 38. Mats 38 and 46 are then rigidly secured together at several locations along the full length of the pathway using several spaced-apart fasteners 31.

Figure 7:
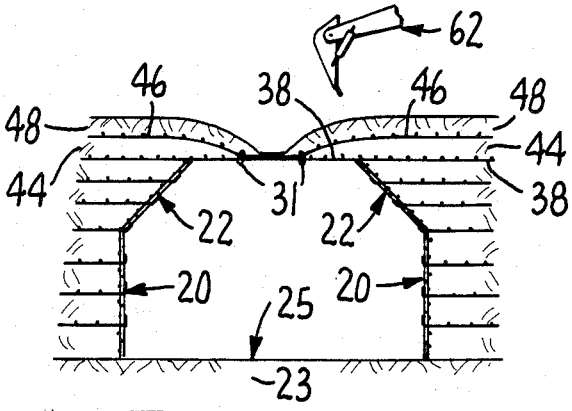

As shown in FIG. 7, a second layer of unbound fill 48 is then deposited over flat mats 46 using backhoe 62. A relatively narrow longitudinal central region of reinforcement mats 38 is not covered with fill so that a small section of mats 38 will remain exposed along the length of the pathway. The periphery of fill 48 surrounding the exposed section is tapered at roughly the same angle as that of fill 44.

Figure 8:
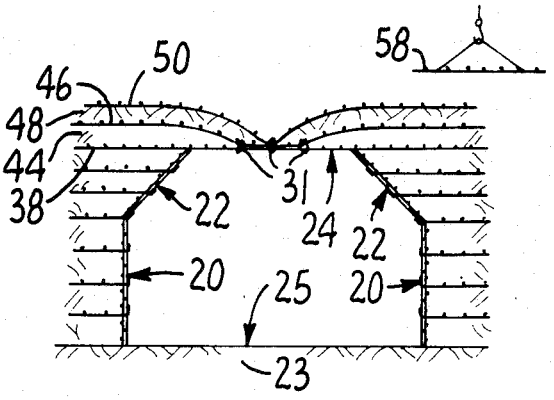

Once fill 48 has been compacted, a third course of reinforcing mats 50 is positioned on top of the fill as shown in FIG. 8. Mats 50 are preformed to conform to the surface defined by fill 48 and wire mat 46 and includes a depressed central section which lies adjacent mats 46. Additional spaced-apart fasteners 31 are used to secure mats 38, 46 and 50 together along the central portion of the mats.

Figure 9:
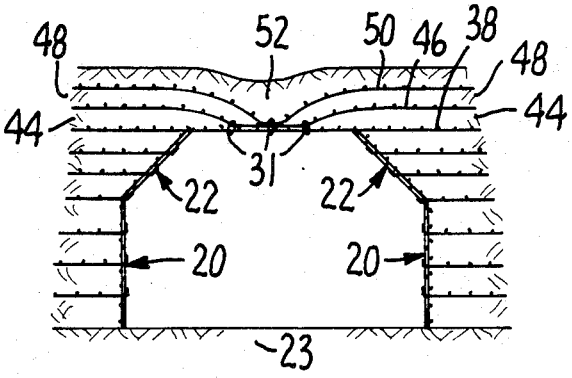
Figure 10:
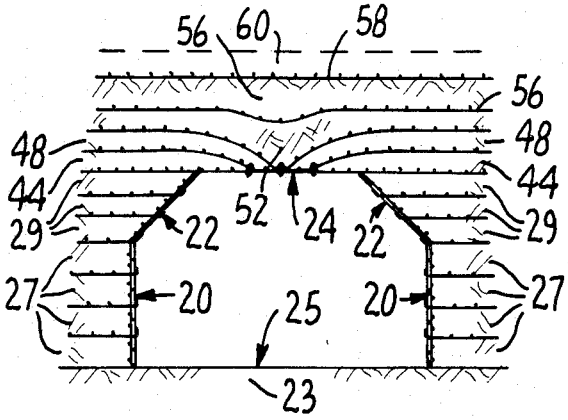

As shown in FIG. 9, unbound fill 52 is then laid over wire mats 50. A longitudinal depression is formed in the center of fill 52 above the region where mats 38, 46 and 50 are fastened together, but does not extend down to the mats. After fill 52 has been compacted, further preformed reinforcing mats 54 are positioned over fill 52 as shown in FIG. 10. Mats 54 have a central depression which is received by the corresponding recess in fill 52.

Unbound fill 56 is then laid over mat 54, with the top surface of the fill being generally flat after compacting. Final flat mats 58 are then positioned over fill 56, and further unbound fill 60 is deposited over the mats. An overpassing roadway or the like can then be constructed over fill 60, if desired.

The vertical and cantilevered wall portions 20 and 22, respectively, of the vertical support sections provide a rigid and extremely strong foundation for supporting ceiling section 24. Bases 26 and 34 of the reinforcing mats carry almost the entire load, with mat faces 28 and 36 supporting very little of the load but, rather, serving primarily to hold the fill adjacent the faces in position. Although not depicted, the reinforcing mats of the vertical support and ceiling sections adjacent the forward and rear ends of the archway have vertical faces which maintain the adjacent fill in position in the same manner as mat faces 28 and 36, such vertical faces typically being transverse to the mat faces.

The five reinforcing mats 38, 46, 50 and 54 of ceiling section 24 stabilize the section and distribute the load of the section over a large area. Mats 46 and 50 are secured directly to lower reinforcing mat 38 and provide vertical support for the center of the ceiling section. Mats 46 and 50 have a gradual slope thereby minimizing stresses on the mats which would occur if abrupt angles were present. The gradual slope also tends to transfer the downward loading of the ceiling section away from the center of the archway towards the vertical support sections. The central depression in reinforcing mat 54 serves to position the mat generally equidistant between mats 50 and 58 so as to reduce the volume of fill which is not reinforced.

Figure 2:
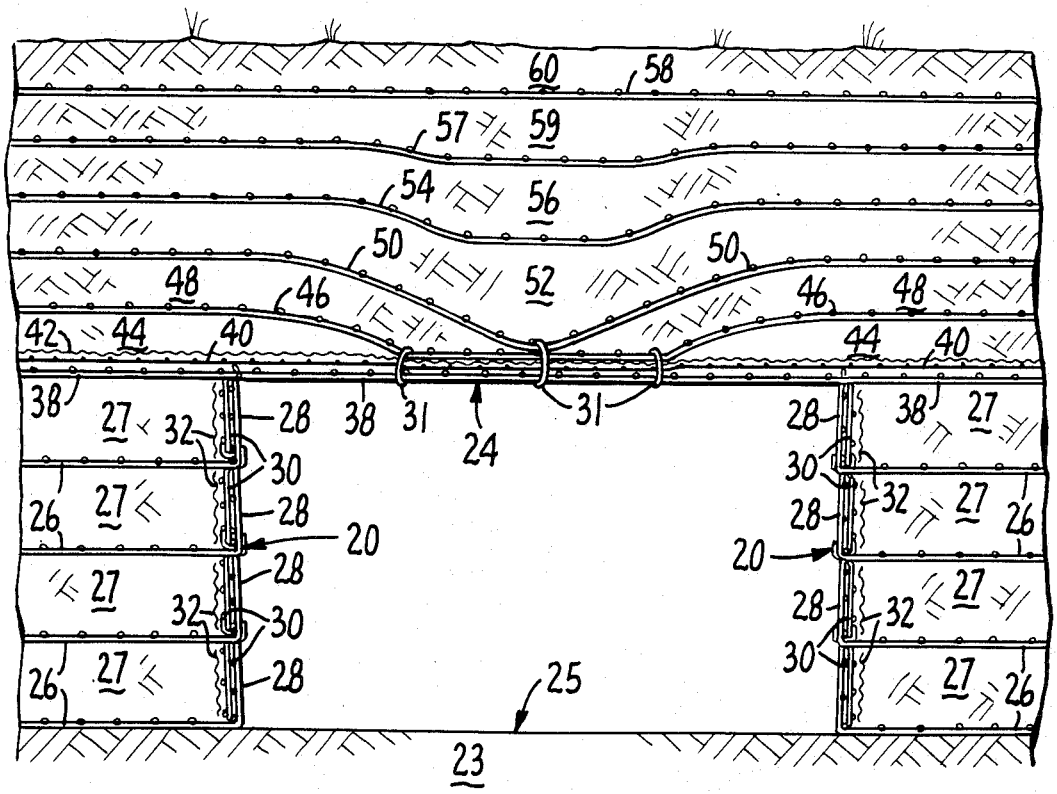
FIG. 2 is a cross-sectional view of a first alternative embodiment the subject invention.

A first alternative embodiment archway is shown in FIG. 2 where elements similar to the preferred embodiment archway are designated with the same numerals. The first alternative embodiment includes a pair of vertical support sections, generally designated by the numeral 20, which are positioned on opposite sides of pathway 25. Vertical support sections 20, which are similar in construction to the vertical portions of the preferred embodiment archway, include four courses of reinforcing mats having mat bases 26 and transverse mat faces 28. Backing mats 30 and wire mesh 32 are positioned behind the mat faces to retain unbound fill 27 in position.

The first alternative embodiment archway also includes a ceiling section, generally designated by numeral 24, which extends over pathway 25 and which is supported by the vertical support sections 20. Ceiling section 24 is constructed in the same manner as the ceiling section of the preferred embodiment archway and includes reinforcing mats 38, 46, 50, 54, 57 and 58. Mats 48 and 50 are connected directly to lower mat 38 by way of fasteners 31 in the same manner as in the preferred embodiment archway. An additional reinforcing mat 57 is provided, intermediate mats 54 and 58, to provide greater reinforcement so as to compensate for the lack of the cantilever wall portions 22.

Figure 11:
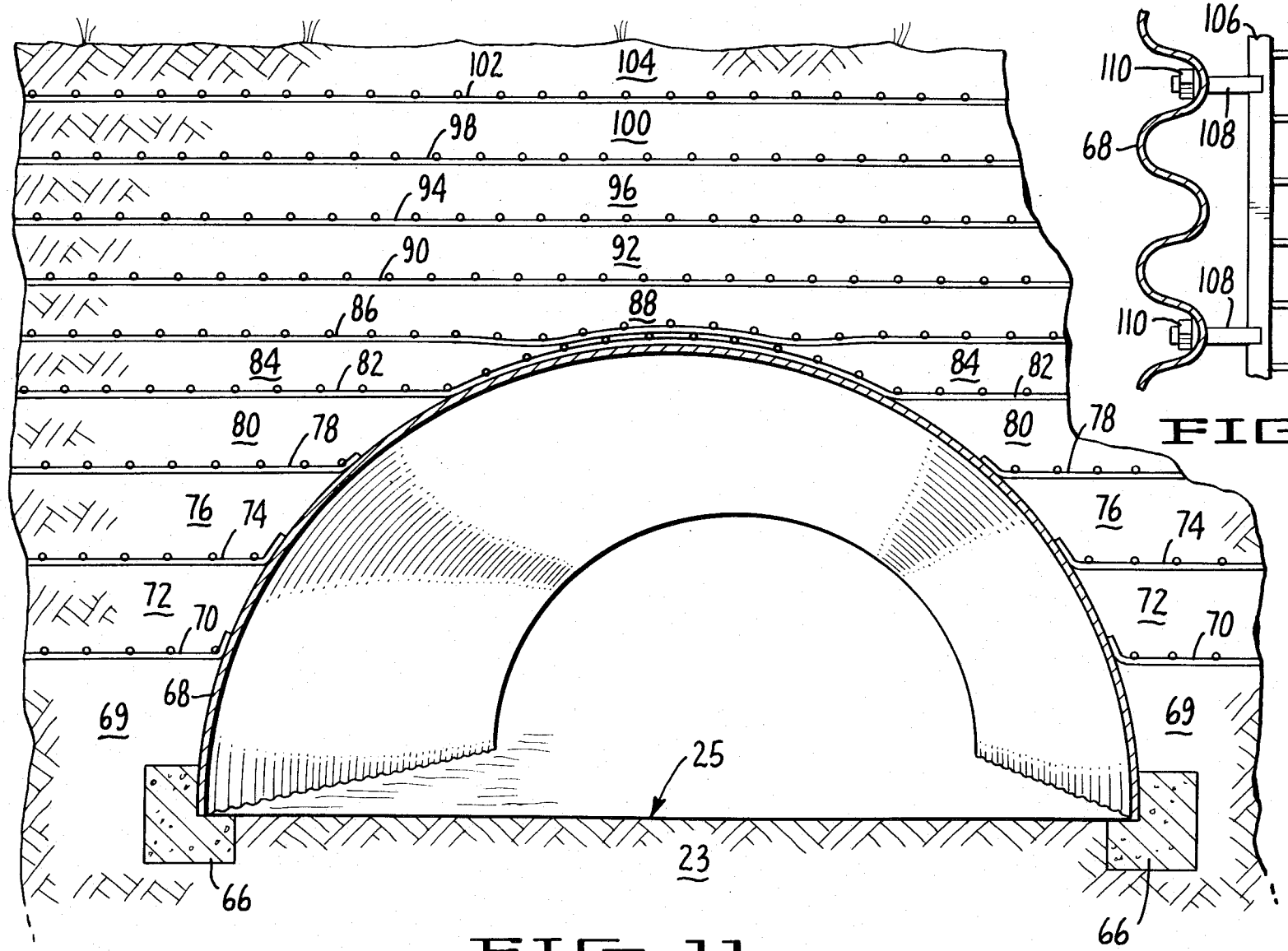
FIG. 11 is a cross-sectional perspective view of a second alternative embodiment of the subject invention utilizing a corrugated metal liner.

Referring now to FIG. 11, a second alternative embodiment archway utilizing a corrugated metal liner 68 may be seen. A channel is first excavated in the area where the archway is to be constructed. The base 23 of the channel is then compacted, if required, to provide a foundation for a roadway or the like over pathway 25. A concrete foundation 66 is then laid on each side of pathway 25. The foundation is provided with an orthogonal notch or step on the pathway side of the foundation. A corrugated metal liner 68 is installed on the foundations 66, resting on the horizontal portion of the orthogonal notches. Liner 66 preferably is galvanized or provided with a corrosion inhibiting coating and has a semi-circular cross section. A series of interconnected slightly overlapping metal sections may be required if the length of the archway is greater than a single section.

The bottom edges of liner 68 are supported between concrete foundations 66 within the notches of the foundation. Unbound fill 69 is added adjacent concrete foundations 66 to provide a base for a first course of steel reinforcing mats 70. Fill 69 should be compacted to avoid settling.

Reinforcing mats 70 are generally flat and are fabricated from steel wire in a manner similar to the reinforcing mats of the two previously-described archways. Mats 70 are preferably provided with a small upturned lip which is positioned adjacent liner 68, but which is not attached to the liner.

Figure 12:
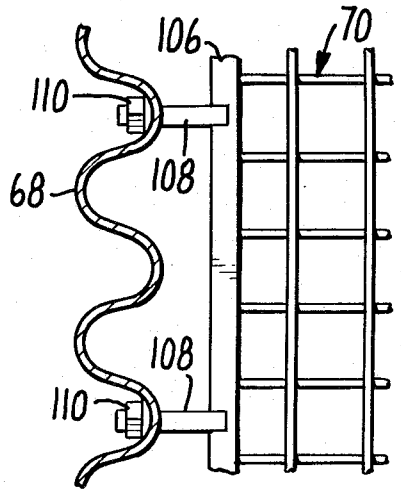
FIG. 12 illustrates the manner in which a reinforcing mat may be attached to a corrugated metal liner.

FIG. 12 shows an alternative construction where the reinforcing mats are attached to liner 68. In this construction, the inner edges of the reinforcing mats, mat 70 for example, are provided with a steel rod 106 which extends along the full width of the mat. Rod 106 is fastened to the end of each of the longitudinal wires of the mat by welding or the like. A series of spaced-apart threaded studs 108 are secured to rod 106, also by welding, opposite and parallel to the mat. Studs 106 are received in corresponding openings in metal liner 68 and are secured in place by nuts 110.

Referring again to FIG. 11, once reinforcing mats 70 have been installed, additional unbound fill 72 is added and compacted. A second course of reinforcing mats 74 is laid over fill 72, with the inner edges of the mats resting adjacent liner 68. Again, mats 74 are preferably provided with a small lip which is positioned next to the liner. Fill 76 is then added and covered with reinforcing mats 78 to form a third course. Once the third course is covered with fill 80 and compacted, construction of the vertical support sections is completed. The vertical support sections have arcuate surfaces which engage metal liner 68.

The horizontal ceiling structure of the second alternative embodiment archway includes reinforcing mats 82 which are positioned over fill 80 and the liner. Mats 82 are provided with a central arcuate section so that the mat conforms to the planer surfaces of fill 80 and the curved surface of liner 68. Fill 84 is then placed over mats 82 and compacted. The fifth course is completed by disposing a fifth set of reinforcing mats 86 over fill 84 and liner 68. Again, mats 86 are provided with a central slightly arcuate section so that the mat conforms to the surfaces of fill 84 and liner 68.

Unbound fill 88 is then laid on top of mats 86 and compacted. Generally flat steel reinforcing mats 90 are then positioned over fill 90. A further layer of fill 92 is deposited and compacted, followed by alternating flat mats and fill layers, including mats 94, 98 and 102 and fill layers 96, 98 and 104. The assembly of the horizontal ceiling section completes the construction of the archway. The reinforcing mats adjacent the front and rear of the archway typically include mat faces (not depicted) which are generally transverse the pathway and which serve to contain the fill at the archway front and rear. A roadway or the like may then be constructed over top fill layer 104.

Metal liner 68 of the second alternative embodiment archway primarily serves the same function as the mat faces 28 and 30 of the previously-described archway embodiments by maintaining the fill located adjacent the liner in position. Liner 68 also provides some vertical support for the archway, although most of the vertical support is provided by virtue of the various reinforcing mats which stabilize the fill.

One advantage of the second alternative embodiment archway is that the interior of the archway has a more finished appearance than the previously-described embodiments. However, since liner 68 prevents the passage of water, steps may be necessary to provide adequate drainage.

Figures 13, 14:
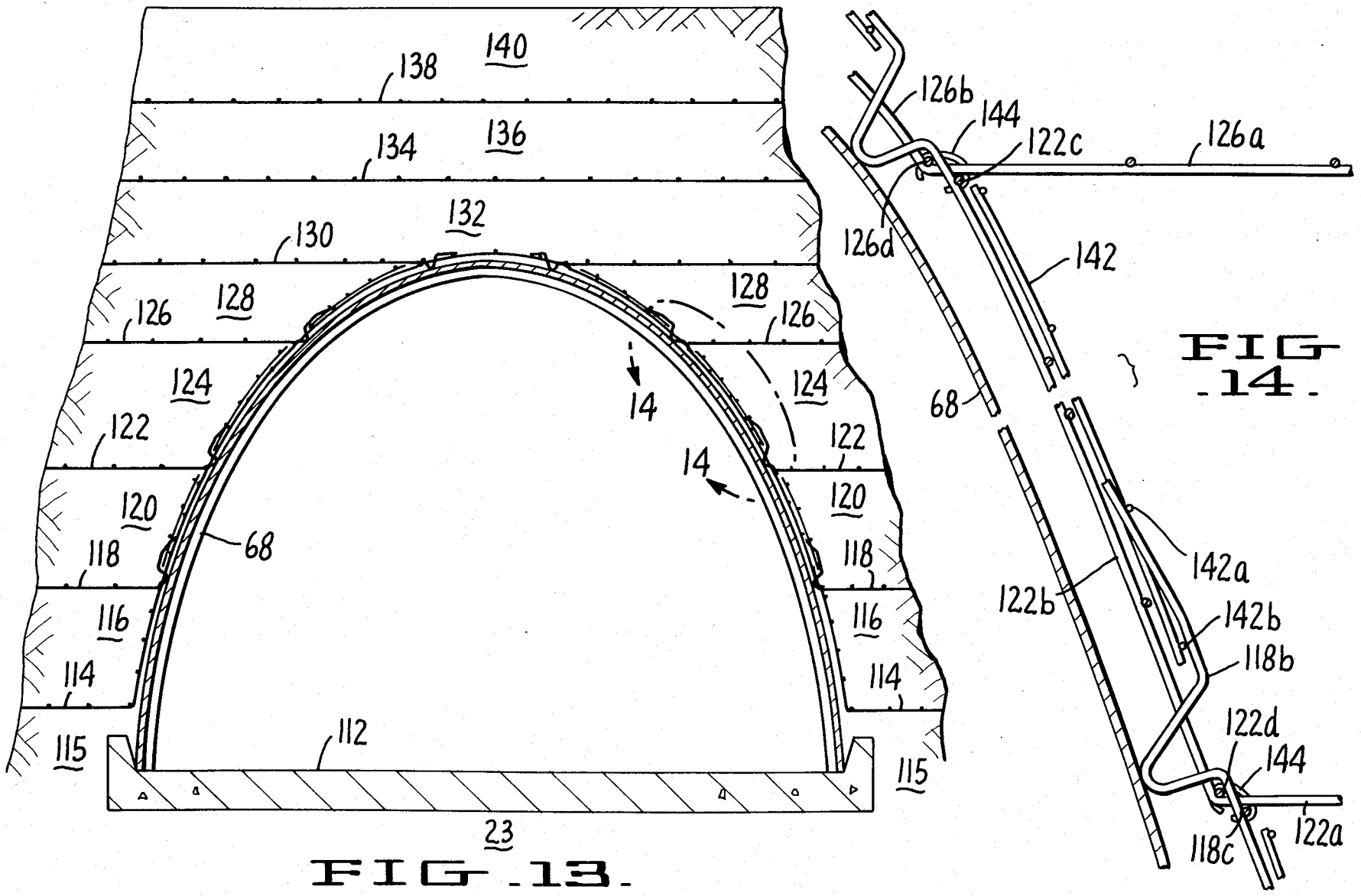
FIG. 13 is a cross-sectional view of a third alternative embodiment of the subject invention utilizing a corrugated metal liner.
FIG. 14 is an enlarged partial view of the FIG. 13 third alternative embodiment archway illustrating the manner in which adjacent reinforcing mats may be secured together.

Referring now to FIG. 13, the third alternative embodiment archway also includes a corrugated metal liner 68. Metal liner 68 has a generally semi-eliptial cross section. After a channel has been excavated in the area where the archway is to be constructed, a concrete foundation 112 is laid along the central portion of the base 23 of the channel. Foundation 112 is in the form of a concrete slab having upwardly-extending projections along the periphery of the slab.

Once the foundation is in place, metal liner 68 is positioned on the foundation between the projections. A plurality of interconnected liner sections may be required, depending upon the length of the archway. Next, unbound fill 115 is laid over channel base 23 on each side of liner 68. The fill is then compacted and reinforcing mats 114 are positioned over the fill. Reinforcing mats 114 are somewhat similar to the mats used in the vertical and cantilevered portions of the preferred embodiment archway and includes horizontal mat bases and mat faces which are disposed at variable obtuse angles with respect to the mat bases. The angle of the mat faces is somewhat greater than 90 degrees so that the mat faces will lay relatively flat against the surface of the metal liner.

Fill 116 is then laid over mats 114 and compacted. Initially, fill is not deposited adjacent the mat face so that a backing mat (not shown) similar to backing mat 30, may be installed behind the mat facing. Next, a second course of reinforceing mats 118 is positioned over fill 116. As will be subsequently described, the longitudinal wires of the mat faces of bottom mat 114 extend away from the mat face to form prongs for engaging mats 118. The angle between the base and face of mats 118 is also somewhat greater than 90 degrees so that the faces of the mats will lie relatively flat against liner 68. The void behind the bottom mat 114 facing is then filled through mat 118 and compacted by rodding.

Fill 120 is then placed over mat 118 and compacted, with a void being maintained adjacent the mat faces. A third course of mats 122 is positioned over the fill with the faces of mats 122 resting against liner 68. Prior to the positioning of mat 122, backing mats are installed behind the face of mats 118. Fill is laid over mats 122, compacted and a fourth course of reinforcing mats 126 is placed over the fill. The face of mats 126 are disposed at an angle somewhat greater than 90 degrees so that the mat faces will rest against liner 68. In each instance, voids are created and filled in the area adjacent the mat faces to accommodate the backing mats.

FIG. 14 illustrates the manner in which the reinforcing mats of the vertical support sections of the third alternative embodiment archway are interconnected. Further details regarding the construction of the interconnecting structure is disclosed in previously-noted application Ser. No. 497,867. Mats 118, 122 and 126 are shown for purposes of illustration. The reinforcing mats associated with the vertical and cantilevered wall portions of the vertical support sections of the preferred and first alternative embodiment archways are constructed similarly. Mats 122 each include a mat base 122*a* and a mat face 122*b*. The longitudinal wires of mat face 122*b* extend substantially past the top cross wire 122*c* of mat 122 to form a series of prongs. Each prong is provided with a U-shaped bend which rests on liner 68 and which is disposed just above the top cross wire.

Mat base 122*a* is positioned on the top cross-wire 118*c* of mat 118, with cross wire 122*d*, located at the juncture of the base and face of mat 122, being positioned adjacent wire 118*c*. The prongs of mat face 118*b* extend up between cross wires 118*c* and 122*d* and behind mat face 122*b*. A series of hog rings 144 are used to pin cross wires 122*d* and 118*c* together thereby locking mats 122 and 118 together. Prior to installation of mat 126, a backing mat 142 is positioned behind mat face 122*b*. The bottom cross-wire 142*b* of backing mat 142 is positioned between the prongs 118*b* of mat face 118 and mat face 122*b*. The next from bottom cross-wire 142*a* of backing mat 142 is positioned on the opposite side of prongs 118*b*, thereby locking the backing mat to the remainder of the assembly. Once backing mat 142 is in position, reinforcing mat 126 is secured to mat 122 in a similar manner. Gravel is then poured through mat base 126*a* to fill the void adjacent backing mat 142, and is compacted by rodding.

Referring back to FIG. 13, once mats 126 are in position, fill 128 is then laid over mats 126 and in the void beind the face of mats 122. Again, a void is retained adjacent the mat faces so that the backing mats may be installed. This completes the construction of the vertical support sections of the archway.

Construction of the ceiling section is then commenced. Relatively flat mats 130 are positioned over fill 128 and the top surface of liner 68. Unbound fill 132 is added, followed by flat mats 134 and 138 which are alternated with fill layers 136 and 140. Preferably, the reinforcing mats of the vertical support and ceiling section adjacent the front and rear of the archway are provided with mat faces generally transverse to the mat faces adjacent liner 68. The transverse mat faces serve to hold the fill adjacent the front and rear of the archway in position.

Figure 15:
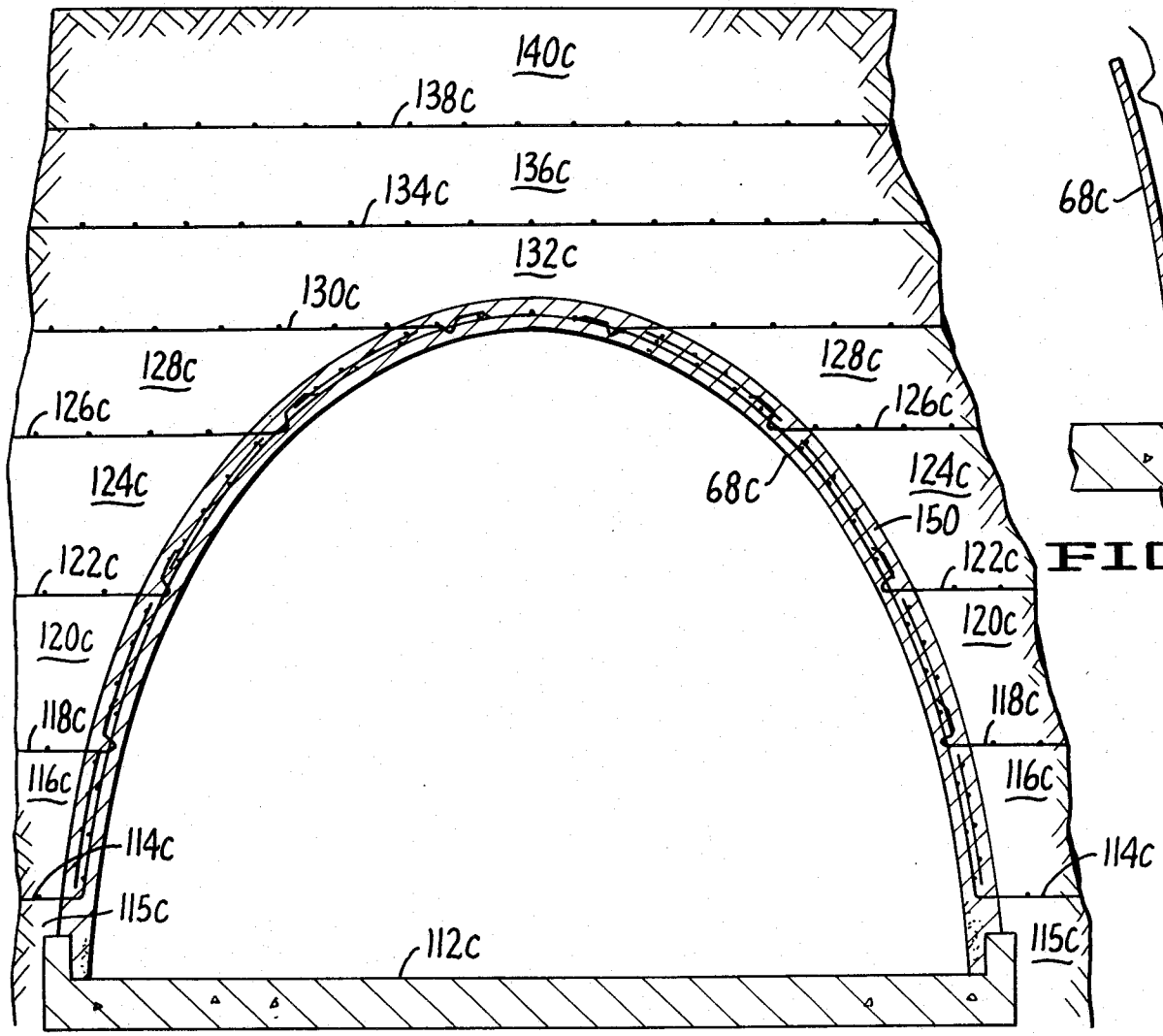
FIG. 15 is a cross-sectional view of a fourth alternative embodiment of the subject invention utilizing a formed in place concrete liner.

Referring now to FIG. 15, the fourth alternative embodiment corresponds substantially to the third alternative embodiment, except that a removable form 68*c* is used in place of the corrugated metal liner 68 and a concrete face 150 is cast in place against the removable form as the archway is constructed. Components of the fourth alternative embodiment are designated by numerals corresponding to those of the third alternative embodiment, followed by the letter "c", as follows: foundation 112*c*; mats 114*c*, 118*c*, 122*c*, 126*c*, 130*c*, 134*c*, and 138*c*; fill layers 115*c*, 116*c*, 120*c*, 124*c*, 128*c*, 132*c*, 136*c* and 140*c*.

Figure 17:
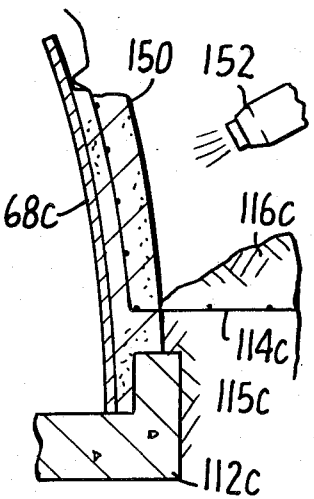
FIGS. 16, 17 and 18 are enlarged partial views of the FIG. 13 fourth embodiment archway illustrating the manner in which the concrete liner is progressively formed during the construction of the archway.
Figure 18:
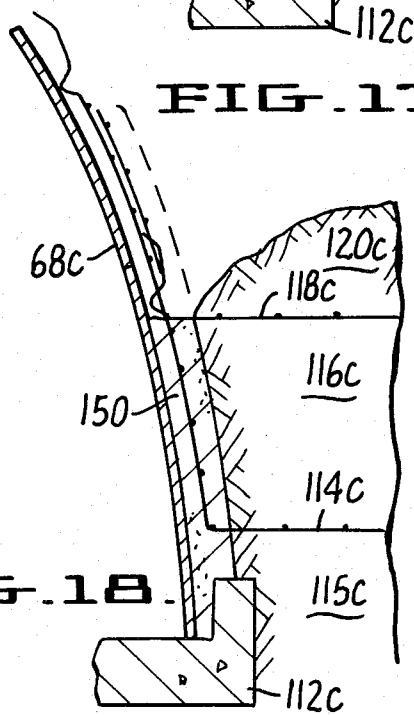
Figure 16:
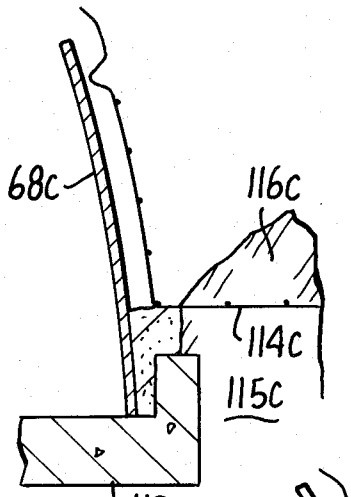

The sequence of construction of the fourth alternative embodiment of FIGS. 15 to 18 is the same as that of the third alternative embodiment, except that the concrete face 150 is progressively formed as may be seen from FIGS. 16, 17 and 18 as the archway is constructed, and ultimately the form 68*c* is removed. As shown in FIGS. 16, 17 and 18, the concrete face is placed through a GUNITE process (see GUNITE nozzle 152 in FIG. 17). Thus, as seen in FIG. 16, a first section of the face is formed between the form 68*c* and the foundation 112*c*. Then the fill 115*c* is placed and compacted and the mat 114*c* is placed on the fill, with a partial layer of the fill 116*c* placed thereabove. Next, another section of the face 150 is formed against the form 68*c* and around the face section of the mat 114*c*. The latter step may be seen from FIG. 17. Next, the remainder of the backfill layer 116*c* is placed and compacted and then the mat 118*c* is positioned and partially covered with backfill 120*c*, as seen in FIG. 18.

The sequence of progressively placing backfill, mats and forming the concrete face is progressively carried out until the entire arch is completed. During this sequence, it is not necessary to permit the section of the concrete face to cure prior to the placement of the backfill. The backfill may actually be placed against the wet concrete.

Although the concrete face has been illustrated and described as being formed by a GUNITE process, it should be appreciated that other types of forming may be used. For example, the layers of the face may be formed with a slip form which is moved up as each successive layer is formed. It should also be appreciated that the face sections of the mats are embedded within the concrete face. Thus, the edges of the mats proximate the archway are secured to the face and function to reinforce the concrete.

Upon completion of the fourth alternative embodiment archway, the concrete face is permitted to cure and then the form 68*c* is removed. The form 68*c* is formed in segments to facilitate its erection and removal. Suitable bracing (not illustrated) may be employed to hold the form in place.

Thus, a novel archway construction has been disclosed. Although several embodiments of the subject archway have been described in some detail, it is to be understood that various changes could be made by persons having average skill in the art without departing from the spirit and scope of the subject invention as defined by the appended claims. By way of example, the reinforcing mats may be fabricated from materials other than metal such as plastic and the like. In addition, the reinforcing mat bases may be comprised of a plurality of generally parallel straps attached and transverse to the mat faces rather than being in the form of an orthogonal grid.

I claim:

1. An archway construction over a pathway comprising:

a pair of vertical support sections disposed on opposite sides of the pathway;

a ceiling section which extends over the pathway and which is supported by said vertical support sections; and wherein said vertical support sections each include a plurality of reinforcing mats separated by one or more layers of unbound fill and said ceiling section includes a plurality of reinforcing mats, including a first mat and a second mat disposed above and connected to said first reinforcing mat.

2. The archway of claim 1 wherein said vertical support sections each include a lower vertical portion and an upper cantilevered portion, with said cantilevered portions extending at least partially over said pathway.

3. The archway of claim 2 wherein said reinforcing mats each include a plurality of longitudinal metal strands generally transverse to the pathway and cross metal strands which are generally parallel with the pathway and which are connected to said longitidinal strands.

4. The archway of claim 3 wherein said longitudinal and cross metal strands are in the form of wires.

5. The archway of claim 1 wherein said first and second reinforcing mats are positioned adjacent one another in a region approximately midway between said vertical support sections and are separated in other regions by a layer of unbound fill.

6. The archway of claim 5 wherein said ceiling section further includes a third reinforcing mat disposed above said second reinforcing mat and connected to said first reinforcing mat.

7. The archway of claim 6 wherein said third and second reinforcing mats are positioned adjacent one another in a region approximately midway between said vertical support sections and are separated in other regions by a layer of unbound fill.

8. The archway of claim 5 wherein said vertical support sections have arcuate surfaces which engage said metal liner.

9. The archway of claim 8 wherein said reinforcing mats each include a plurality of longitudinal metal strands generally transverse to the pathway and cross metal strands which are generally parallel to the pathway and which are connected to said longitudinal strand.

10. The archway of claim 8 wherein said reinforcing mats of said ceiling section extend over at least part of said vertical support sections.

11. The archway of claim 10 wherein edges of said reinforcing mats of said vertical support sections proximate said pathway terminate generally at said metal liner.

12. The archway of claim 10 wherein edges of said reinforcing mats of said vertical support sections proximate said pathway are attached to said metal liner.

13. The archway of claim 10 wherein said reinforcing mats of said vertical support sections include a base section and a face section which is disposed at an obtuse angle with respect to said base section and wherein said face sections rest against said metal liner.

14. The archway of claim 13 wherein adjacent ones of said face sections of said vertical support section mats are coupled together.

15. The archway of claim 1 further including a concrete liner formed within the archway beneath said ceiling section and between said vertical support sections.

16. The archway of claim 15 wherein edges of said reinforcing mats are embedded in said concrete liner.

17. The archway of claim 15 wherein the reinforcing mats of said vertical support sections include a base section and a face section which is disposed at an obtuse angle with respect to said base section, and wherein said face sections are embedded within said concrete liner.

18. The archway of claim 17 wherein adjacent ones of said face sections of said vertical support section mats are coupled together.

19. A method of constructing an archway over a pathway comprising the following steps:

producing a first vertical support section, having an exposed surface facing the pathway, by alternately positioning reinforcing mats and layers of unbound fill adjacent the pathway;

producing a second vertical support section, having an exposed surface facing the pathway, by alternately positioning reinforcing mats and layers of unbound fill adjacent the pathway opposite said first vertical support section; and producing a ceiling section, subsequent to said steps of producing said vertical support sections, by alternately positioning reinforcing mats and layers of unbound fill over said first and second vertical support sections spanning the pathway.

20. The method of claim 19 wherein said first and second vertical support sections and said ceiling section are positioned over a metal liner.

21. The method of claim 20 wherein said metal liner is a corrugated liner having an arcuate cross section.

22. The method of claim 21 wherein inner edges of said reinforcing mats of said first and second vertical support sections which are proximate the pathway are positioned adjacent said liner.

23. The method of claim 22 wherein said inner edges of said mats are connected to said liner.

24. The method of claim 22 wherein said inner edges of said mats are not connected to said liner.

25. The method of claim 19 wherein said first and second vertical support sections each include a lower vertical portion and an upper cantilevered portion, with said cantilevered portion extending at least partway over the pathway.

26. The method of claim 19 wherein said step of producing said ceiling section includes the following steps:

laying a first reinforcing mat over said first and second vertical support sections which spans the pathway;

depositing a first layer of fill over said first reinforcing mat, leaving a central region approximately midway between said vertical support sections of said first reinforcing mat exposed;

laying a second reinforcing mat over said first layer of fill; and connecting said first and second reinforcing mats together at said central region.

27. The method of claim 26 wherein said step of producing said ceiling section includes the following additional steps:

depositing a second layer of fill over said second reinforcing mat, leaving a central region approximately midway between said vertical support sections of said second reinforcing mat exposed;

laying a third reinforcing mat over said second layer of fill; and connecting said first and third reinforcing mats together at said central region.

28. The method of claim 27 wherein said step of producing said ceiling section includes the following additional steps:

depositing a third layer of fill over said third reinforcing mat;

laying a fourth reinforcing mat over said third layer of fill; and depositing a fourth layer of fill over said fourth reinforcing mat.

29. The method of claim 19 further comprising forming a concrete liner within the archway simultaneously with the production of the first and second support sections and the ceiling section.

30. The method of claim 29 wherein the concrete liner is formed by:

positioning a form over the pathway in advance of positioning the first and second support sections and the ceiling wall section;

placing wet concrete against said form as each reinforcing mat and layer of unbound fill is placed so that edges of said mats are embedded within the concrete and the fill layers are disposed against the concrete in backing relationship thereto.

31. The method of claim 30 wherein the mats are bent so as to have face sections embedded in the concrete to serve as reinforcement therefor.

32. A method of constructing an archway over a pathway comprising the following steps:

producing a first vertical support section by alternately positioning reinforcing mats and layers of unbound fill adjacent the pathway;

producing a second vertical support section by alternately positioning reinforcing mats and layers of unbound fill adjacent the pathway opposite said first vertical support section; and producing a ceiling section by (i) laying a first reinforcing mat over said first and second vertical support sections which spans the pathway; (ii) depositing a first layer of fill over said first reinforcing mat, leaving a central region approximately midway between said vertical support sections of said first reinforcing mat exposed; (iii) laying a second reinforcing mat over said first layer of fill; and (iv) connecting said first and second reinforcing mats together at said central region.

33. The method of claim 32 wherein said step of producing said ceiling section includes the following additional steps:

depositing a second layer of fill over said second reinforcing mat, leaving a central region approximately midway between said vertical support sections of said second reinforcing mat exposed;

laying a third reinforcing mat over said second layer of fill; and connecting said first and third reinforcing mats together at said central region.

34. The method of claim 33 wherein said step of producing said ceiling section includes the following additional steps:

depositing a third layer of fill over said third reinforcing mat;

laying a fourth reinforcing mat over said third layer of fill; and depositing a fourth layer of fill over said fourth reinforcing mat.

35. An archway construction over a pathway comprising:

an arcuate metal liner disposed over the pathway;

a pair of vertical support sections disposed on opposite sides of said metal liner, with each of said vertical support sections including a plurality of generally horizontal reinforcing mats separated by a layer of unbound fill, with said mats having a proximate edge adjacent said metal liner; and a ceiling section disposed over said metal liner, with said ceiling section including a plurality of reinforcing mats separated by a layer of unbound fill.

* * * * *